United States Patent [19]

Phipps et al.

[11] 4,316,680

[45] Feb. 23, 1982

[54] AIR-ASSISTED HYDRAULIC RE-CIRCULATORY BOUYANCY PUMP

[76] Inventors: Peter Phipps, c/o George Spector, 3615 Woolworth Bldg., 233 Broadway; George Spector, 3615 Woolworth Bldg., 233 Broadway, both of New York, N.Y. 10007

[21] Appl. No.: 80,177

[22] Filed: Oct. 1, 1979

[51] Int. Cl.[3] ..... F04F 1/18

[52] U.S. Cl. ..... 406/49; 37/61; 417/108

[58] Field of Search ..... 417/108–117, 417/163, 165, 337; 406/46, 49, 153; 37/61, 62

[56] References Cited

U.S. PATENT DOCUMENTS

| | | | |
|---|---|---|---|
| 1,932,497 | 10/1933 | Wellensiek | 417/320 |
| 3,010,232 | 11/1961 | Skakel et al. | 37/61 X |
| 4,028,009 | 6/1977 | Gudzenko et al. | 417/163 X |
| 4,106,817 | 8/1978 | Tsuzuku et al. | 406/49 |

*Primary Examiner*—William L. Freeh
*Assistant Examiner*—Edward Look

[57] ABSTRACT

A pump system for being set up to work in deep water, for use in sea bed mining; the system including three pipes, a first of which carries compressed air downward and to a lower portion of a main second or eduction pipe through which mined material is carried upwardly with sea water, and a third pipe also carrying bouyancy media downward to the lower portion of the main pipe, so to assist the upward flow of the water carrying the mined material.

5 Claims, 10 Drawing Figures

AIR
27
16
18
28
26
18
16
34
10
33
11
AIR
18
16
12
32
18
AIR
26
13
18
31
14
16
16
15

AIR-ASSISTED HYDRAULIC RE-CIRCULATORY BOUYANCY PUMP

This invention relates generally to underwater mining systems. More specifically it relates to a new type of underwater pumping system.

It is well known to those who are acquainted with the particular field, that the mining of material from a sea floor located at a great depth, presents a problem of trying to carry the material upwardly inside conduit pipes, as the material tends to drop downwardly as the water serving as a vehicle to carry the material, flows upwardly. Accordingly, powerful pumps are conventionally used so as to maintain a fast upward flow of the water vehicle; such powerful pumps being expensive to operate.

It is a principal object of the present invention to provide an improved pumping system that utilizes a force of bouyancy for lifting the water vehicle, thereby eliminating the expense of operating the powerful pumps for accomplishing the same.

Another object is to provide a bouyancy pump which has no moving parts so that there is nothing to break down operationally, and accordingly can run indefinitely.

Yet another object is to provide a bouyancy pump which, with exception of an air compressor and an re-circulatory pump for a bouyancy media, requires less energy fuel so to operate.

Figure 1:
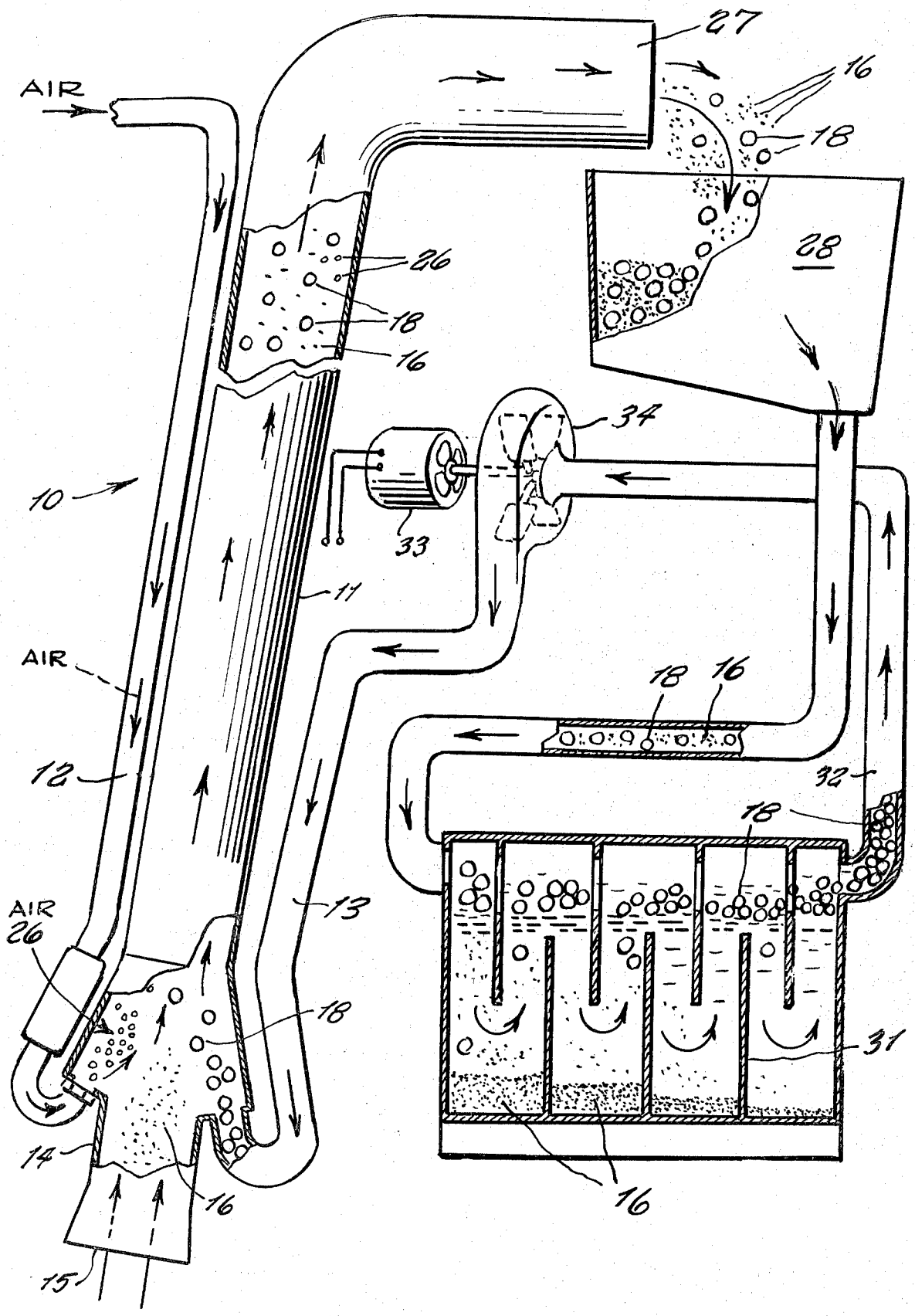
FIG. 1 is a diagrammatic view of the invention hyraulic circuit.

Referrng now to the drawings in greater detail, the reference numeral 10 represents an air-assisted hydraulic re-circulatory bouyancy pump, according to the present invention. Basically the pump consists of three pipes comprising a main or eduction pipe 11 for carrying a mined material upwardly by sea water, an air supply pipe 12 attachable to an air compressor (not shown in the drawings) and a bouyancy media supply pipe 13, the pipes 12 and 13 being connected to a headpiece (or footpiece) 14 at a lower end of the eduction pipe, as shown in FIG. 1. The headpiece includes a spout 15 that is open on its underside in order to scoop up a mined material 16 on the sea floor, the material being fragmented small so that it can be carried by sea water 17 sucked in by the spout and moved upwardly in the pipe 11.

As shown in FIG. 1, air in the form of bubbles is thus discharges from the pipe 12 into the headpiece and then floats upwardly into a lower end of the eduction pipe.

Figure 8:
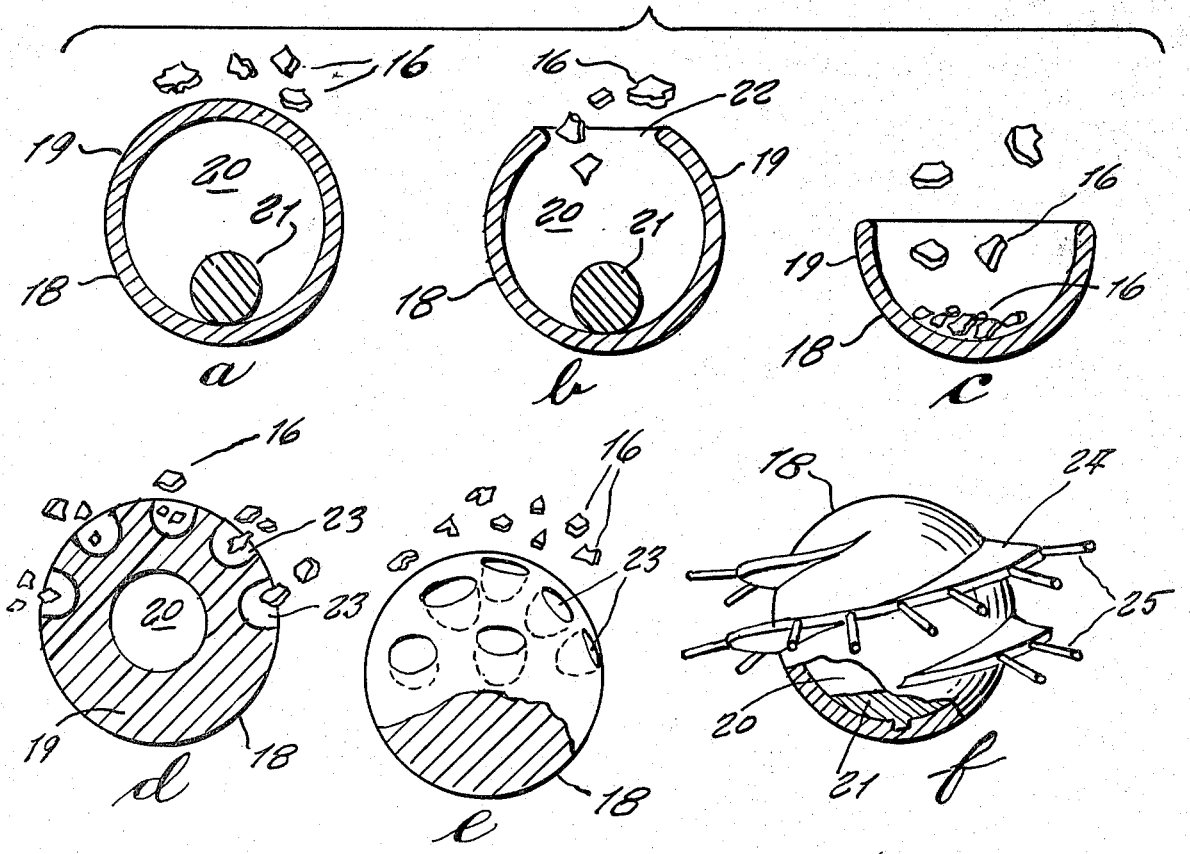
FIG. 8 is a view showing several different designs of bouyancy media spheres; the sphere at f having a spiral fin so to rotate the sphere, and radially outward bristles on the fin serving to agitate the liquid.

The bouyancy media pipe 13 serves to deliver bouyancy media pipe 18 into the headpiece and lower end of the eduction pipe. The bouyancy media comprises numerous small semi-bouyant spherical shells 19 molded preferably of a plastic material, or of rubber or other suitable substance. Several different types of bouyant media are shown in FIG. 8. The media at 8*a* shows the shell hermetically sealing an air-filled central chamber 20. A small lead weight 21 is contained inside the chamber. The media 8*b* shows the weight 21 affixed at a bottom of the shell (by being molded therewith), and a large opening 22 at its upper end so to admit the sea water into the central chamber together with particles of mined material carried by the water. The media at 8*c* is similar to the media at 8*b* but has a larger opening by being made almost hemi-spherical, and not including the lead weight. The media at 8*d* has a spherical shell 19 of relatively greater thickness around a sealed central air chamber 20, and an outer surface of the shell upper side is notched with a plurably of pockets 23 so as to catch the mined material particles 16 therein. The media at 8*e* is a same as media 8*d* except that the sphere is made solid without any center chamber 20. The media a 8*f* is generally a same as the media at 8*a* with the lead weight affixed in the bottom of the sealed chamber, and additionally including a spiral fin 24 around its outer side and spiralled about a vertical central axis of the media. A plurality of radially outwardly extending bristles 25 along an outer edge of the fin serves to agitate the water as the media rotates therein by screwing itself upwardly in the water during bouyancy. The agitated water retards the mined material particles 16 from dropping downwardly as readily.

As further shown in FIG. 1, the air in the form of air bubbles 26 travel upwardly inside the eduction pipe together with the semi-bouyant media 18 so as to flowingly urge the mined material particles 16 upwardly instead allow them to settle downwardly within the water that carries them.

Power means, not shown in the drawing, may be provided for carrying the content of the eduction pipe upwardly above a sea level surface so as to be discharged from an outlet 27 at an upper end of the eduction pipe and into a hopper 28 which thus catches the water, the particles 16 and the media 18. An outlet pipe 29 from the hopper carries the same to a sediment tank 30 where the mined particles 16 drop behind vertical partitions 31 while the water and media are carried outwardly therefrom through a pipe 32. An electric motor driven pump 33 driver a paddle wheel turbine 34 that pulls the water and media from pipe 32 and into the media supply pipe 13 so as to continue repeating the cycle of operation.

Figure 2:
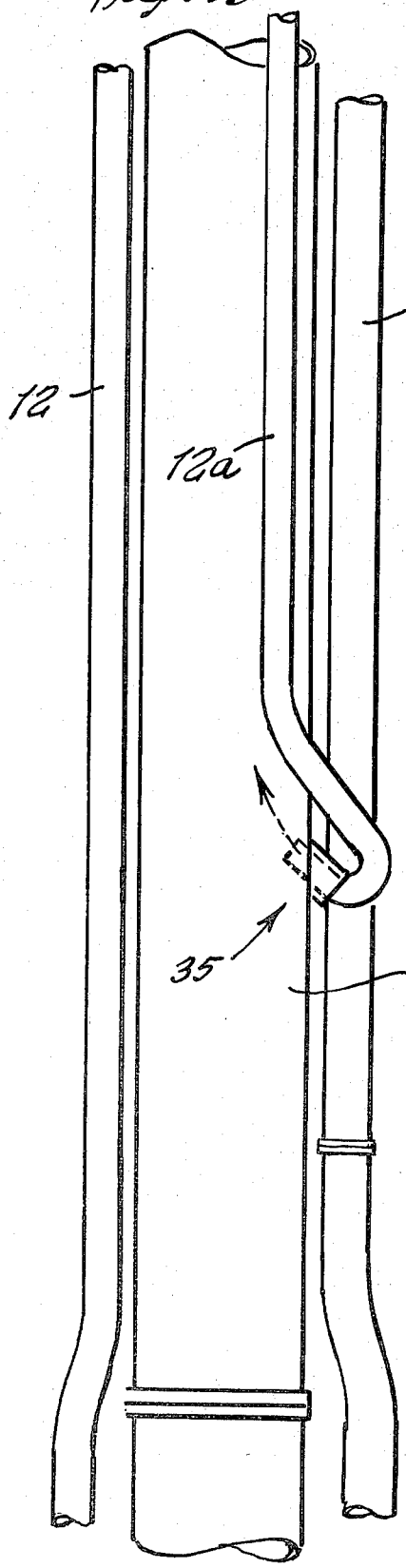
FIG. 2 is a side view showing one of the injectors.

FIG. 2 shows a staged air-water injector 35 which may be provided along every 350 meters of length of the eduction pipe, or at any other desired intervals so as to keep the water of the eduction pipe in a prime condition to carry the particles 16.

Figure 3:
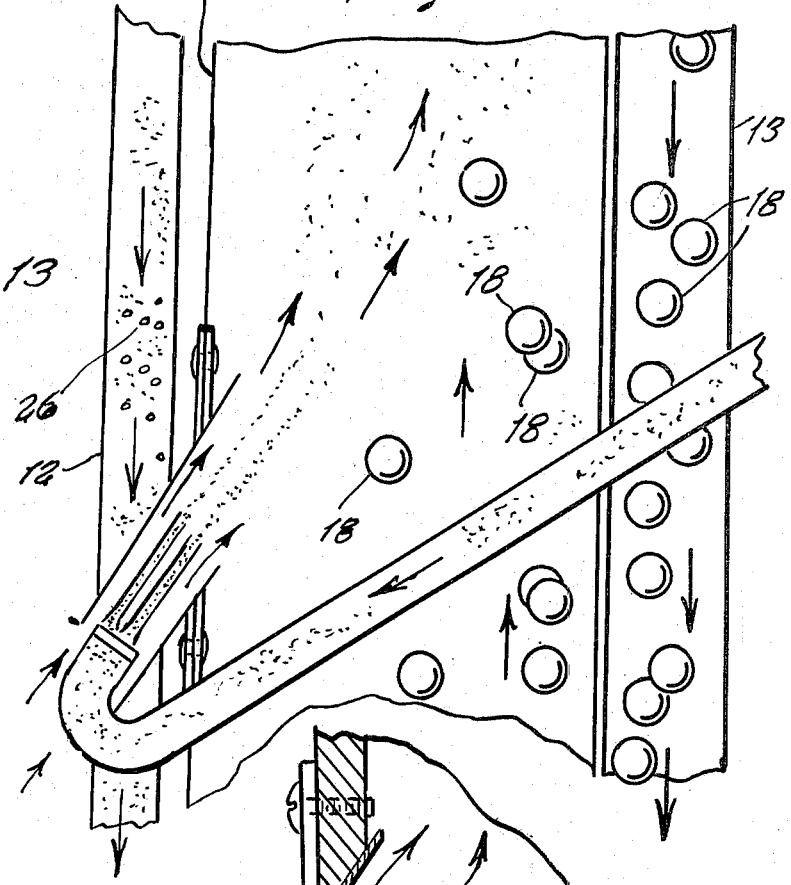
FIG. 3 is an enlarged cross sectional view thereof, in a same plane.
Figure 4:
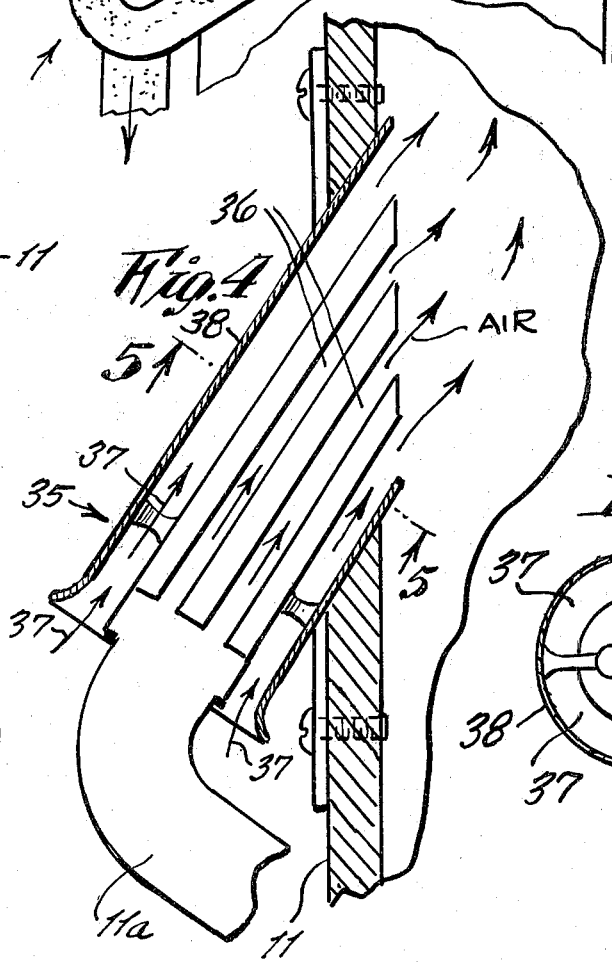
FIG. 4 is a farther enlarged detail of the injector shown in FIG. 3.
Figure 5:
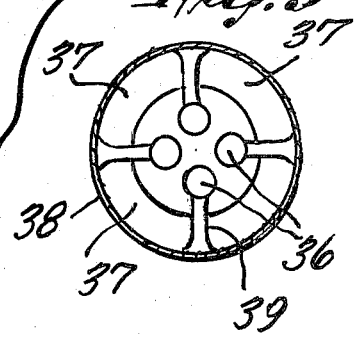
FIG. 5 is a cross sectional view on line 5—5 of FIG. 4.

The ejector 35 shown in greater detail in FIGS. 3, 4 and 5 is mounted on an end of pipe 12*a* which similarly to pipe 12 delivers air from the compressor. In the injector, the air is forced through several smaller diameter tubes 36 which are spaced apart from each other so that water 37 therebetween better mixes with the smaller air bubbles discharged from the tubes than with large air bubbles from a single wide-mouthed air pipe. The water around the tubes moves through a large diameter water intake pipe 38 located around the cluster of tubes 36. Fins 39 support the tubes in a center of the intake pipe.

Figure 6:
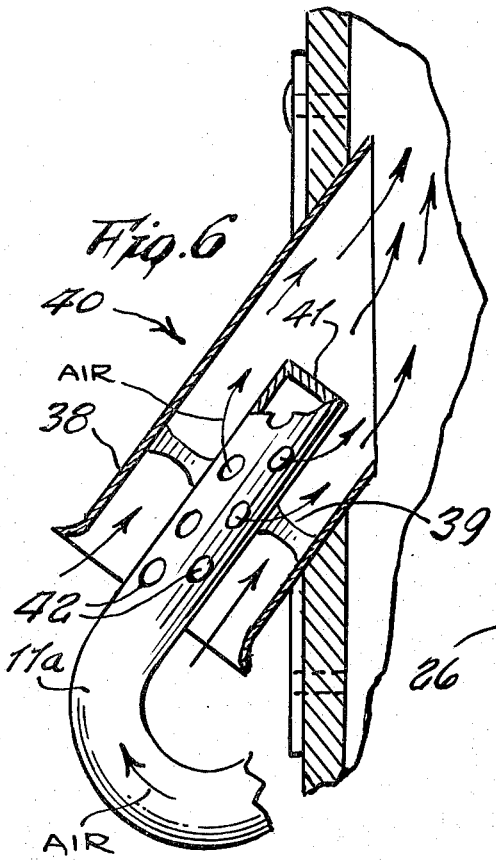
FIG. 6 is a view similar to FIG. 4 showing another design of injector.

In FIG. 6, another design of ejector 40 comprises an end of air pipe 11 a being closed by an end wall 41 while the pipe side is perforated with small holes 42. Thus in this design the small air bubbles discharged from holes 40 mix with the water passing through the intake pipe.

The present invention may be made on a very large scale with pipes being large in cross section and of great length so to reach an ocean bottom.

Figure 7:
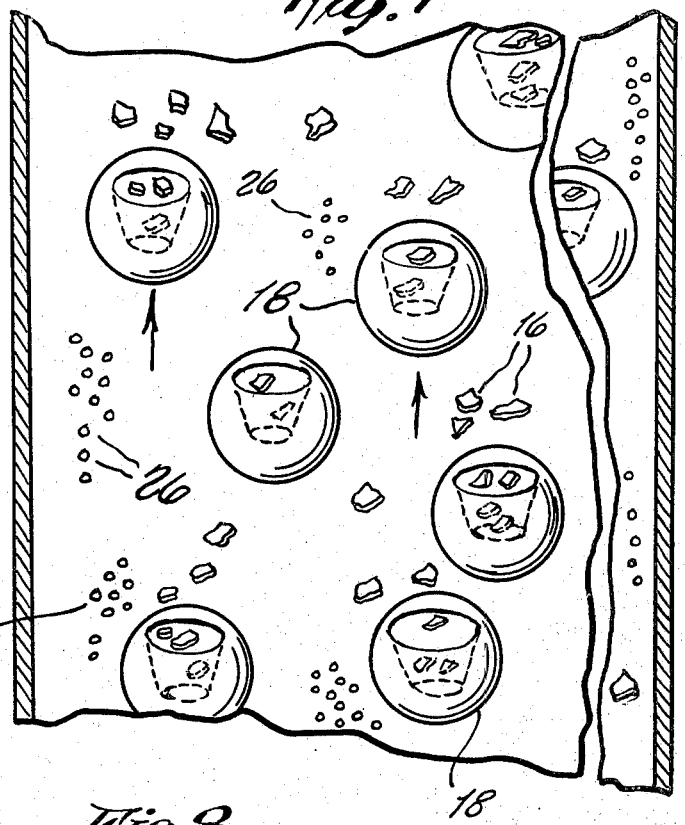
FIG. 7 is a farther enlarged detail of the tube so to more clearly show the bouyancy media spheres.

In FIG. 7 is seen an enlarged detail view of eduction tube 11 showing buoancy media particles 18 in relation to the mined material 16 and air bubbles 26 whereby the said particles 18 and bubbles 26 cooperate in forcing the material 16 upward as desired.

Figure 9:
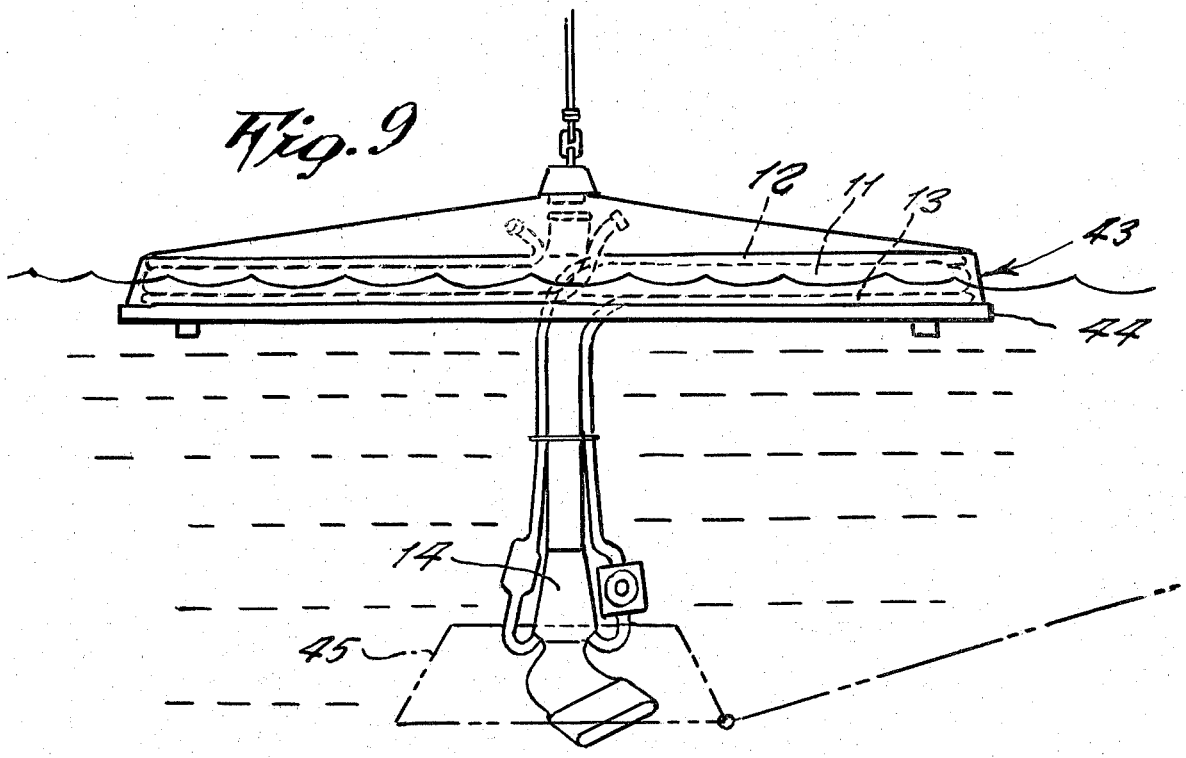
FIG. 9 is a side view of the bouyancy pump shown in collapsed portion so as to be towed behind a vessel toward an operating location.
Figure 10:
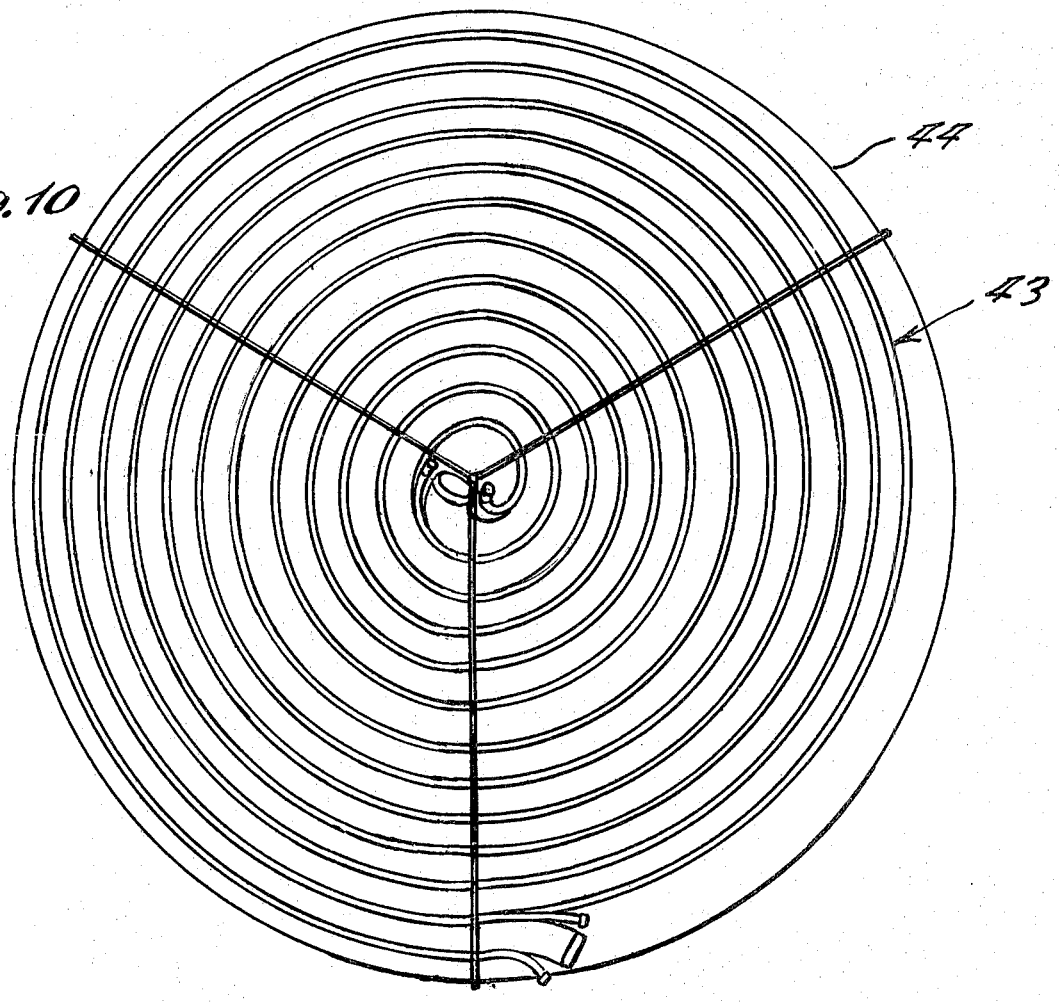
FIG. 10 is a top view of the coiled pump, as viewed on line 10—10 of FIG. 9.

FIGS. 9 and 10 illustrate the bouyancy pump 10 in a collapsed condition so as to be towed by a vessel to a mining site. The pipes are coiled into a flat coil 43 placed upon a floatable large frame 44. The after towing to a site, the headpiece 14 attached to a center of the coil 43 is lowered through the frame as successive turns of the coil unwind by straightening downwardly into the water. The pipes accordingly are of a flexible material and which is preferable to rigid piping so as to withstand from breaking in times of heavy seas.

FIG. 9 shows a trawl dredge frame 45 used during the towing and installation.

What is claimed is:

1. An air-assisted hydraulic re-circulatory bouyancy pump comprising in combination a set of three pipes alongside each other, a first of said pipes comprising an eduction pipe means for carrying a mined material upward from a sea bottom, a second of said pipes comprising a compressed air pipe means connected to a lower end of said eduction pipe means for supplying compressed air to said eductionn pipe means, and a third of said pipes comprising a pipe means connected to said lower end of said eduction pipe means for supplying a plurality of bouyancy particles to said eduction pipe means.

2. The combination as set forth in claim 1 wherein said third pipe is in a mechanical circuit comprising a hopper at an upper discharge end of said eduction pipe, a connecting pipe from said hopper to a sediment tank, another connecting pipe from said tank to a pump connected to an intake end of said third pipe.

3. The combination as set forth in claim 2 wherein each said particles comprises a hollow spherical shell, a lead weight in a lower end of said shell.

4. The combination as set forth in claim 3, wherein said particles include an opening on its top communicating with a central chamber thereof.

5. The combination as set forth in claim 3 wherein an outer upper side of said shell is notched with pockets to catch said mined material.

* * * * *